United States Patent [19]

Oono et al.

[11] Patent Number: 4,973,229

[45] Date of Patent: Nov. 27, 1990

[54] STARTING DISPLACEMENT SETTING DEVICE IN VARIABLE DISPLACEMENT COMPRESSOR

[75] Inventors: Hiromitsu Oono; Seiji Kato; Yasuo Minakawa, all of Wako, Japan

[73] Assignee: Honda Giken Kogyo Kabushiki Kaisha, Tokyo, Japan

[21] Appl. No.: 339,829

[22] Filed: Apr. 18, 1989

[30] Foreign Application Priority Data

Apr. 20, 1988 [JP] Japan ..... 63-97925

[51] Int. Cl.[5] ..... F04B 1/26

[52] U.S. Cl. ..... 417/222; 417/270; 92/12.2

[58] Field of Search ..... 417/222, 270; 92/12.2; 91/506

[56] References Cited

U.S. PATENT DOCUMENTS 4,105,370 8/1978 Brucken et al. ..... 417/222

4,506,648 3/1985 Roberts ..... 417/222

*Primary Examiner*—Leonard E. Smith

*Assistant Examiner*—John A. Savio, III

*Attorney, Agent, or Firm*—Armstrong, Nikaido, Marmelstein, Kubovcik & Murray

[57] ABSTRACT

A driving rotary shaft is rotatably carried on a compressor body of a variable displacement compressor. On axial one side of a sleeve slidably carried on the driving rotary shaft, there is disposed a first spring of a displacement setting device for biasing the sleeve in one axial direction and holding a stopper, with which the sleeve is engageable, at a stop position on the driving rotary shaft. On the axial other side of the sleeve, there is disposed a second spring of the displacement setting device for biasing the sleeve in the other axial direction, the second spring being weaker than the first spring. At the starting of the compressor, the first spring holds the stopper at the stop position against a repulsive force of the second spring to hold the sleeve engaged with the stopper at a fixed position. This makes it possible to set the strengths of individual members and the capacity of a clutch to be smaller than those in the prior art, leading to reductions in size, weight and cost of the entire compressor.

6 Claims, 6 Drawing Sheets

STARTING DISPLACEMENT SETTING DEVICE IN VARIABLE DISPLACEMENT COMPRESSOR

BACKGROUND OF THE INVENTION

1. Field of the Invention

The present invention relates to a device for restricting the starting position of a sleeve which controls the angular position of a swingable swash plate in a variable displacement compressor used for an air cooler of an automobile or the like.

2. Description of the Prior Art

Such a conventional variable displacement compressor is disclosed, for example, in U.S. Pat. No. 4,475,871. In such prior art compressor, two springs are disposed in an opposed relation to each other on opposite sides of a sleeve on a rotary shaft, so that the position of the sleeve is determined by a balance of loads of the opposed springs, thereby determining the displacement of the compressor at the time of starting thereof.

In the variable displacement compressor, it is desirable that the compressor be started with its displacement being set as small as possible to reduce the rising torque, so that the strength of each component thereof and the clutch capacity can be set smaller, resulting in reduction in size, weight and cost. In the prior art compressor, however, there are the following problems: The spring loads exerted on the opposite sides of the sleeve which serves to vary the angular position of the swash plate are as shown by straight lines a and b in FIG. 5, and the position of the sleeve when starting is varied laterally within a certain range with respect to a desired set position depending upon the magnitude of a friction attendant on the lateral movement of the sleeve. Therefore, in designing the strength of each component and the capacity of a clutch, it is necessary to rely on a point within the variation range close to the maximum displacement area as the standard. This causes the strength of each member and &he clutch capacity to be larger than required, bringing about increases in size, weight and cost of the compressor.

SUMMARY OF THE INVENTION

The present invention has been accomplished with the above circumstances in view, and it is an object of the invention to provide a starting displacement setting device in a variable displacement compressor, which is of a simple construction and in which the sleeve can be always held at an optimal set position at the time of Starting of the compressor, to reduce loads exerted on the individual members and the clutch, thus overcoming the problems associated with the prior art.

To attain the above object, according to the present invention, in a variable displacement compressor comprising a compressor body including a housing, a cylinder block and a cylinder head; a driving rotary shaft rotatably carried on the compressor body; a sleeve axially slidably carried on the driving rotary shaft within the housing; a journal supported on the sleeve for swinging movement about an axis perpendicular to an axis of the driving rotary shaft and connected to the rotary shaft; a swingable swash plate carried on the journal so as to be swingable only about the axis of the journal: a plurality of operating pistons connected to the swingable swash plate through a plurality of connecting rods; and a plurality of cylinders disposed around the driving rotary shaft in the cylinder block and each having the corresponding one of the operating pistons slidably received therein, wherein angular positions of the journal and the swingable swash plate are varied by controlling sliding mOvementS of the sleeve, thereby varying operation strokes of the operating pistons, there is provided a starting displacement setting device which comprises a first spring disposed on one of axial opposite sides of the sleeve for biasing the sleeve in one of axial opposite directions and holding a stopper, with which the sleeve is engageable, at a stop position on the driving rotary shaft, a second spring weaker than the first spring, disposed on the axial other side of the sleeve for biasing the sleeve in the other axial direction, whereby at the time of Starting of the compressor, the first spring holds the stopper at the stop position against a repulsive force of the second spring to hold the sleeve engaged with the stopper at a fixed position.

With the above construction, the sleeve on the driving rotary shaft is always held at the fixed position at the time of starting of the compressor by cooperation of the first and second springs which work to bias the sleeve for movements along the driving rotary shaft, with the stopper mounted on the driving rotary shaft to restrict the stroke of the sleeve. Thereby starting loads exerted on the individual members and a clutch are reduced. This makes it possible to set the strengths of the members and the capacity of the clutch to be smaller than those in the prior art. Consequently, it is possible to provide reductions in size, Weight and cost of the entire compressor.

The above and other objects, features and advantages of the invention will become apparent from a reading of the following description of the preferred embodiment, taken in conjunction with the accompanying drawings.

BRIEF DESCRIPTION OF THE DRAWINGS

Drawings illustrate one embodiment of the present invention, wherein.

DESCRIPTION OF THE PREFERRED EMBODIMENTS

The present invention will now be described by way of one embodiment with reference to the accomapnying drawings.

Figure 1:
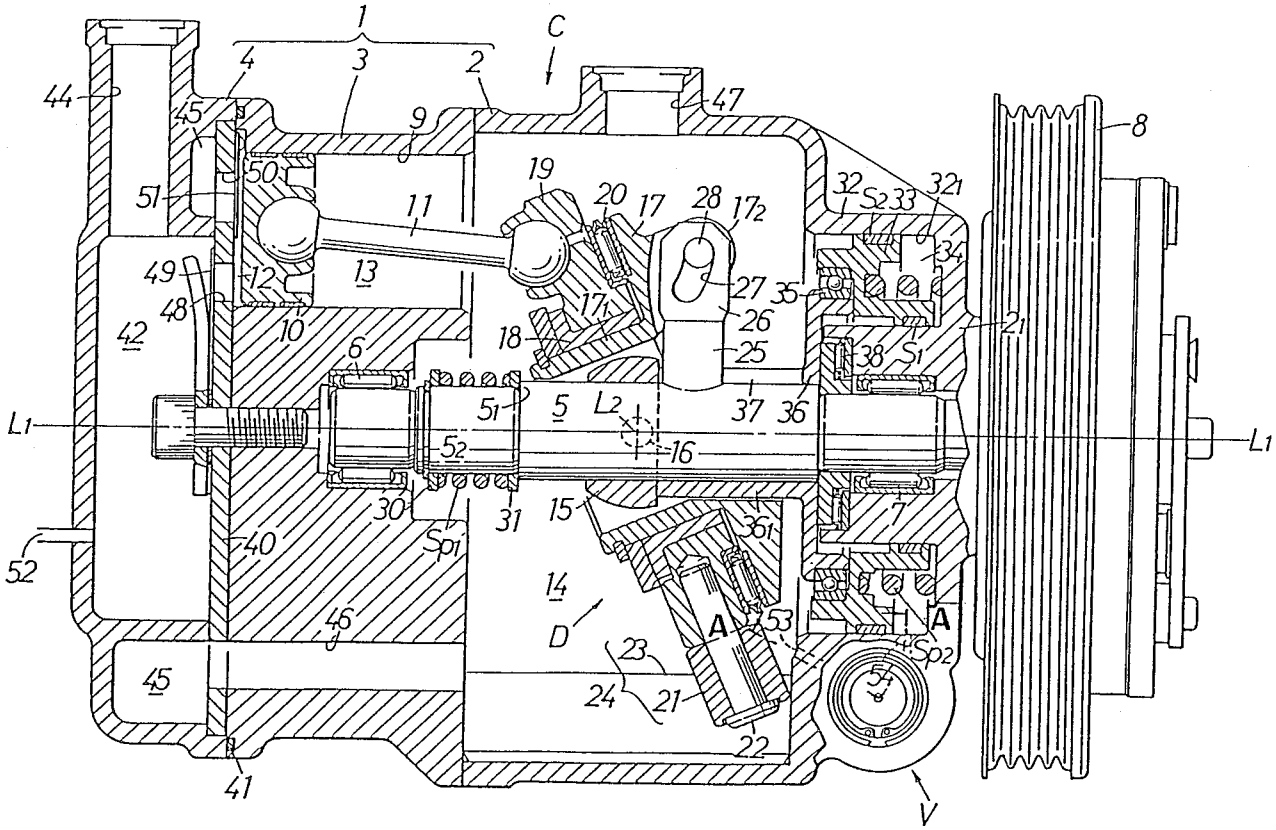
FIG. 1 is a side view in longitudinal section of an essential portion of a variable displacement compressor provided with a device according to the present invention.
Figure 2:
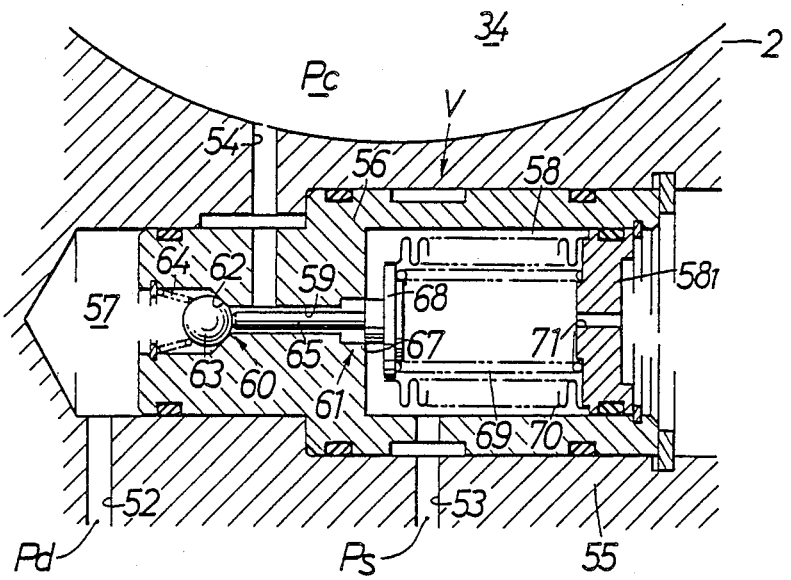
FIG. 2 is an enlarged sectional view taken along a line A—A in FIG. 1.

Referring to FIG. 1, there is shown, in longitudinal section, an essential portion of a variable displacement compressor C in this embodiment. In FIG. 1, a compressor body 1 of the compressor C is generally cylindrically formed of a hollow cylindrical housing 2, a cylinder block 3 secured to an opened end face of the housing 2, and a cylinder head 4 overlaid on an end face of the cylinder block 3, these components being integrally connected.

A driving rotary shaft 6 longitudinally passing through the housing 2 is rotatably carried in the cylinder block 3 and an end wall $2_1$ of the housing 2 through radial needle bearings 6 and 7. The driving rotary shaft 5 lies on an axis L1 of the compressor body 1 and has a clutch-containing driving pulley 8 integrally connected to an end of the shaft 5 projecting from the compressor body 1. The driving pulley 8 is operatively connected to a drive source such as an engine which is not shown, so as to be rotatively driven therefrom.

A plurality of cylinders 9 are formed in the cylinder block 3 in parallel to the driving rotary shaft 5 at uniformly spaced apart distances on a concentric circle having a center provided by axis L1, and an operating piston 10 is slidably received in each of these cylinders 9. Each piston 10 divides the interior of the corresponding cylinder 9 into a compression chamber 12 and a back pressure chamber 13. A connecting rod 11 is rotatably connected at one spherical end thereof to a back of each operating piston 10 on the back pressure chamber side. Each of the connecting rods 11 extends axially within the cylinder 9 with the other spherical end thereof reaching the inside of the housing 2, and is rotatably connected to a swingable swash plate 19 of a swash plate type driving mechanism D which will be described hereinafter.

The structure of the sWash plate type driving mechanism D Will be described below. A sleeve 15 is axially slidably fitted over the driving rotary shaft 5 within a working chamber 14 in the housing 2. A pair of left and right pivots 16 are integrally projected on laterally opposite sides of the sleeve 16 and have a center on an axis L2 (normal to a sheet surface of FIG. 1) perpendicular to the axis L1 of the driving rotary shaft 5. A board-like journal 17 is carried on each of the left and right pivots 16 for backward and forward swinging movement in an axial direction of the driving rotary shaft 5. The swingable swash plate 19 is rotatably carried through a radial bearing 18 on that cylindrical portion $17_1$ of the journal 17 which extends to surround the sleeve 15, and a thrust needle bearing 20 is interposed between opposed faces of the swingable swash plate 19 and the journal 17 . A detent member 21 is connected to an outer end of the swingable swash plate 19 through a connecting pin 22 and slidably engaged in a guide groove 23 which is formed within the working chamber 14 in parallel to the driving rotary shaft 5 to extend between the cylinder block 3 and the end face $2_1$ of the housing 2. The guide groove 23 and the detent member 21 compose a detent mechanism 24 for the swingable swash plate 19.

A drive pin 25 is integrally provided on the driving rotary shaft 8 to diametrically project therefrom within the working chamber 14. The drive pin 25 is integrally formed at its leading end with connecting arms 26 each of which has an arcuate engage hole 27 made therein. An engage pin 28 integrally projecting from a mounting piece $17_2$ of the journal 17 is slidably engaged in the engage hole 27. The arcuate engage hole 27 permits a swinging movement of the swingable sWash plate 19 about the pivot 16 to an extent of a length of the engage hole 27. The journal 17 rotates, as the driving rotary shaft 5 rotates.

As described above, the other spherical ends of the connecting rods 11 connected to the corresponding pistons 10 are rotatively connected to one face of the swingable swash plate 19. Accordingly, the operation stroke of each operating piston 10, i.e., the displacement depends upon the angular position of the swingable swash plate 19 about the axis L2 of the pivot 16.

Figure 4:
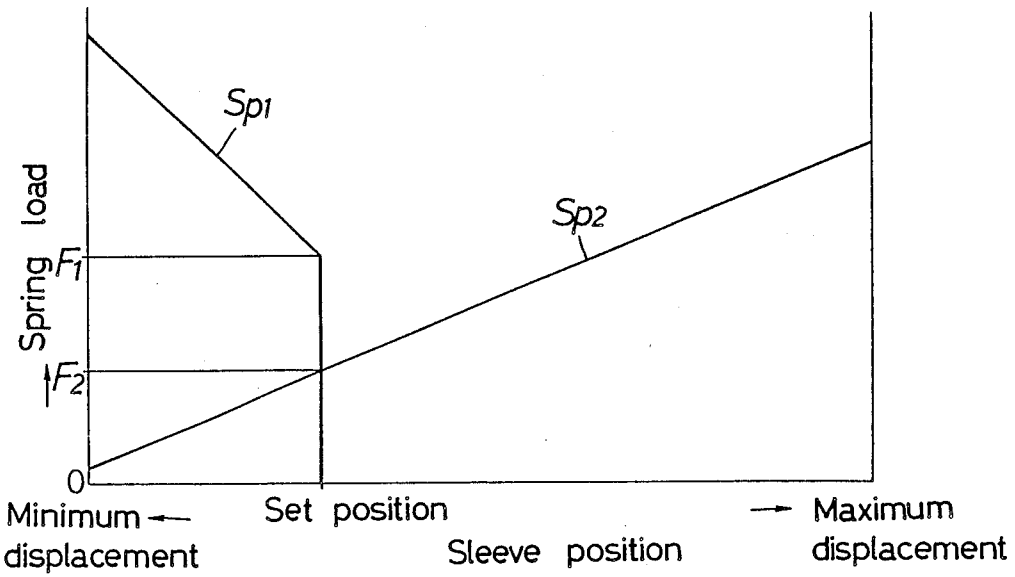
FIG. 4 is a graph illustrating a relationship between a sleeve and first and second springs.
Figure 5:
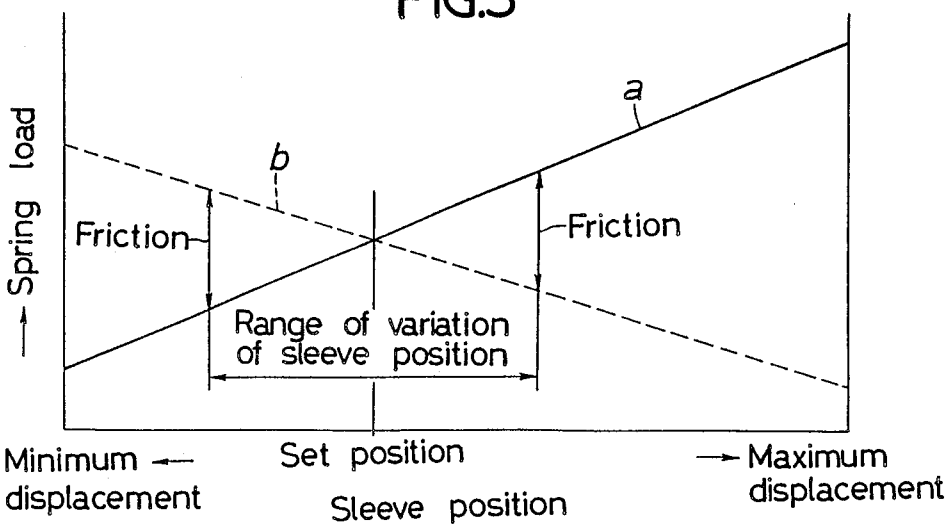
FIG. 5 is a graph illustrating a relationship between a sleeve and a pair of springs in the prior art.

The driving rotary shaft 5 has a smaller diameter shank portion $5_2$ formed at its end closer to the cylinder block S through a locking stepped portion $5_1$. A first spring SP1 comprising a compression coiled spring is wound around the smaller diameter shank portion $5_2$ and engaged at one end thereof on a spring seat 30 lookedly fitted over the smaller diameter shank portion $5_2$ and at the other end thereof on an annular stopper 31 locked to the locking stepped portion $5_1$. When the sleeve 15 slides leftward as viewed in FIG. 1, the stopper 31 engages with one end face of the sleeve 15 to compress the first spring SP1. The spring load of the first spring SP1 is reduced, as the sleeve 15 moves to a displacement increasing side, i.e., rightward, as shown in FIG. 4.

The housing 2 is integrally provided at a central portion of its end wall $2_1$ with an outward projecting cylindrical bottomed cylinder portion 32 concentrically with the driving rotary shaft 5, and an annular control piston 33 is slidably received in an annular cylinder $32_1$ formed in the cylinder portion 32. Seal rings S1 and S2 are fitted respectively around inner and outer peripheral surfaces of the control piston 33 in an axially misaligned arrangement to provide a fluid-tight sealing between the respective inner and outer slide surfaces of the cylinder $32_1$ and control piston 33. Even if a force intended to tilt the control piston 33 acts on the latter, these seal rings S1 and S2 act to control the tilting of the control piston 33 against such force due to their arrangement misaligned axially of the control piston 33.

A control pressure chamber 34 is defined between the control piston 33 and an end wall of the cylinder portion 32. A second spring SP2 comprising a compression coiled spring is contained in the control pressure chamber 34 and has opposite ends engaged between the control piston 33 and the end wall of the cylinder portion 32 (a bottom wall of the cylinder $32_1$) to bias the control piston 33 leftward as viewed in FIG. 1, i.e., toward the working chamber 14. The control piston 33 is rotatably carried at its end closer to the working chamber 14 on a control plate 36 through an annular ball bearing 35. The control plate 36 is integrally formed with an axially extending cylindrical portion $36_1$ which is rotatably fitted over and carried on an outer peripheral surface of the driving rotary shaft 5, with its end face engaged with an end face of the sleeve 15 by a repulsive force of the second spring SP2. In addition, the cylindrical portion $36_1$ is provided with an axial slit 37 through which the drive pin 25 extends, so that the driving rotary shaft 5 and the control plate 36 rotate in unison. A thrust needle bearing 38 is interposed between a back of the control plate 36 and the end wall $2_1$ of the housing 2. If the control piston 33 slides laterally, the sleeve 15 moves axially to follow the control piston 33 and with such movement, the angular positions of the journal 17 and the swingable swash plate 19 about the pivot 16 are varied. Specifically, when the control piston 33 moves leftward, the sleeve 15 also moves leftward. With such movement, the journal 17 and the swingable swash plate 19 turn clockwise, leading to a reduced slide stroke of each operating piston 10. On the other hand, when the control piston 33 moves rightward, the sleeve 15 also moves rightward due to an operational pressure acting on the operating piston 10. With such movement, the journal 17 and the swingable swash plate 19 turn counterclockwise as viewed in FIG. 1, leading to an increased slide stroke of each operating piston 10.

The short cylindrical cylinder head 4 is secured to an end face of the cylinder block through a partition plate 40 with a packing 41 interposed therebetween. The cylinder head 4 includes a discharge chamber 42 centrally defined therein, with a boundary of the discharge chamber 42 with the cylinder block 3 being provided by the partition plate 40. A discharge line 44 formed in the cylinder head 4 communicates with the discharge chamber 42. The cylinder head 4 includes an intake chamber 45 also defined therein to surround the discharge chamber 42, with a boundary of the intake chamber 45 with the cylinder block 3 being also provided by the partition plate 40. The intake chamber 45 communicates with the working chamber 14 in the housing 2 through a communication passage 46 made in the cylinder block 3. Further, an intake line 47 made in a wall of the housing 2 communicates with the working chamber 14.

The partition plate 40 is provided with a discharge port 48 which permits the communication between the discharge chamber 42 and the compression chamber 12 in the cylinder 9, and a discharge valve 49 is mounted in the discharge port 48 and adapted to open the discharge port 48 when the operating piston 10 is in compressing operation. The partition plate 40 is further provided with an intake port 50 Which permits the communication between the intake chamber 45 and the compression chamber 12 in the cylinder 9, and an intake valve 51 is mounted in the intake port 50 and adpated to open the intake port 50 when the operating piston 10 is in drawing operation.

When the plurality of operating pistons 10 are reciprocally moved in sequence by the intake stroke of the compressor C, a refrigerant is passed through the intake line 47, the Working chamber 14 and the communication passage 46 into the intake chamber 45 from Which it is draWn into the compression chamber 12 by opening of the intake valve 51. As a result of a compressing stroke of the compressor C, the compressed refrigerant in the compression chamber 12 opens the discharge valve 49 and is pumped through the discharge chamber 42 into the discharge line 44.

The displacement control of the variable displacement compressor C constructed in the above-described manner is performed by a control valve V. The construction of this control valve V will be described below. The control valve V is interposed among a discharge passage 52 leading to the discharge chamber 42, an intake passage 53 leading to the intake chamber 45 via the working chamber 14 and the communication chamber 46 and a control passage 54 leading to the control pressure chamber 34.

A valve body 56 is mounted in a valve housing 55 formed on the end wall $2_1$ of the housing 2. The valve body 56 defines, within the valve housing 55, a discharge pressure valve chest 57 with Which the discharge passage 52 communicates, and the valve body 66 also includes a suction pressure valve chest 58 with which the intake passage 53 communicates, and a passage 59 with which the control passage 54 communicates. The passage 59 permits the communication between the discharge pressure valve chest 57 and the suction pressure valve chest 58.

The valve body 56 is provided with a first valve mechanism 60 capable of putting the discharge pressure valve chest 57 and the passage 59 into and out of communication with each other, and a second valve mechanism 61 capable of putting the passage 59 and the suction pressure valve chest 58 into and out of communication with each other.

The first valve mechanism 60 comprises a valve sphere 63 seatable on a valve seat 62 formed on the valve body 56, a valve spring 64 for biasing the valve sphere 63 in a valve-closing direction, and a push rod 66 for operating the valve sphere 63 in a valve-opening direction. The valve sphere 63 and the valve spring 64 are mounted in the discharge pressure valve chest 57, and the push rod 65 is movably passed longitudinally through the passage 59.

The second valve mechanism 61 comprises a valve spool 68 integral with the push rod 65 and seatable on a valve seat 67 formed on the valve body 56, and a valve spring 69 for biasing the valve spool 68 in a valve-closing direction. The valve spool 68 and the valve spring 69 are contained in the suction pressure valve chest 58 defined in the valve body 56.

A bellows 70 is contained in the suction pressure valve chest 58 to surround the valve spring 69 and is fluid-tightly connected at its opposite ends to the valve spool 68 and an end plate $58_1$ of the suction pressure valve chest 58. The inside of the bellows 70 communicates with the atmosphere via a through hole 71 made in the end plate $58_1$ Thus, if the sucked pressure Ps in the suction pressure valve chest 58 is increased, the bellows 70 is shrinked to open the second valve mechanism 61. If the sucked pressure Ps in the suction pressure valve chest 58 is reduced, the bellows 70 is expanded to open the first valve mechanism 60.

The variable control of the discharge displacement will be described below. An air-cooler has a characteristic that if the cooling load is larger, the sucked pressure Ps is increased, whereas if the cooling load is smaller, the sucked pressure Ps is reduced. Therefore, if the cooling load is now decreased resulting in a reduced sucked-pressure Ps, the valve sphere 63 of the first valve mechanism 60 is opened to permit the discharge passage 52 and the control passage 54 into communication with each other, so that the control pressure Pc in the control chamber 34 is increased due to the discharged pressure pd. With such increase, the control piston 33 is moved leftward as viewed in FIG. 1 by the aid of the repulsive force of the second spring SP2 to move the sleeve 15 leftward as shown in FIGS. 8(*a*) to (*b*) through the control piston 36. This causes the journal 17 to be swung clockwise about the pivot 16, i.e., in a direction to right the swingable swash plate 19. Consequently, the operation strokes of the plurality of operating pistons 10 are reduced, and the displacement discharged from the compressor is decreased. When the displacement of the compressor becomes a minimum, the sleeve 15 reaches the left limit as shown In FIG. 3(*b*) to compress the first spring $SP_1$ through the stopper 31.

If the load of the air-cooler is increased resulting in an increased sucked-pressure Ps, then the bellows 70 is shrinked, so that the valve spool 68 of the second valve mechanism 61 is opened, and the first valve mechanism 60 is closed. This brings the passage 59 and the suction pressure passage 53 into communication with each other to reduce the pressure Pc in the control chamber 34. With such reduction, the control piston 33 is moved rightward as viewed in FIG. 1. This causes the sleeve 15 to be moved rightward by reception of a working pressure exerted on the plurality of operating pistons 10. Thus, the journal 17 is moved counterclockwise about the pivot 16 to tilt down the swingable swash plate 19 in the same direction, resulting in an increased operation stroke of each operating piston 10 to provide an increased displacement discharged from the compressor C.

The displacement discharged from the variable displacement compressor C is controlled in the above manner.

Figure 3A:
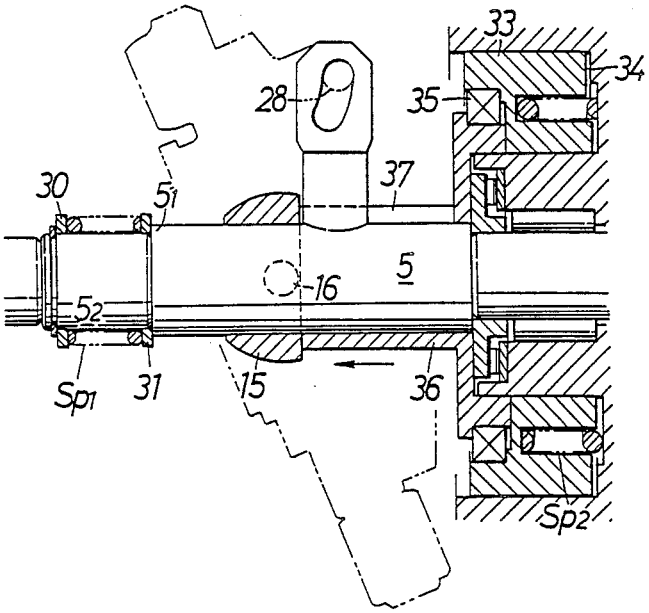
FIGS. 3(*a*) to (*c*) are a fragmentary view for illustrating the operational states of the device according to the present invention.
Figure 3B:
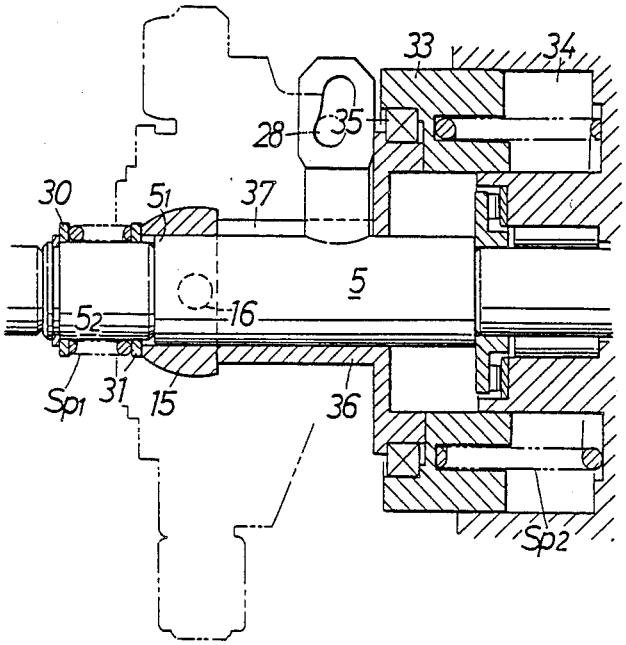
Figure 3C:
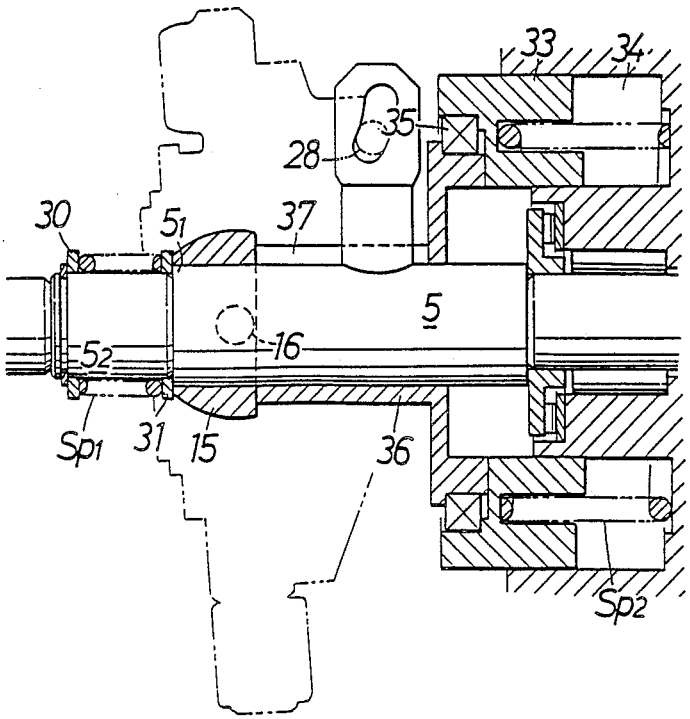

It should be noted that at the starting of the variable displacement compressor C, the repulsive force of the second spring $SP_2$ moves the sleeve 15 leftward until it abuts against the stopper 31, as shown in FIG. 3(*c*), and the spring load F2 (FIG. 4) of the second spring SP2 at this point of time is set, of course, to be larger than a friction attendant on the leftward movement of the sleeve 15.

On the other hand, the repulsive force of the first spring $SP_1$ repulsively locks the stopper 31 on the locking stepped portion $5_1$ of the driving rotary shaft 5. The spring load F1 (FIG. 4) of the spring $SP_1$ at this point is set to be larger than the spring force F2 of the second spring $SP_2$ plus a friction attendant on the rightward movement of the sleeve 15.

By setting of the spring loads of the first and second springs $SP_1$ and $SP_2$ in the above manner, the sleeve 15 is always held at a set position as shown in FIG. 3(*c*) at the starting of the compressor C, and in this position, the stopper 31 is locked on the locking stepped portion $5_1$ by the repulsive force of the first spring $SP_1$ and held at a stop position, and sleeve 15 is engaged with one side of the stopper 31 by the repulsive force of the second spring $SP_2$.

Therefore, in contrast to the prior art wherein the strengths of the individual members and the clutch capacity have been set larger than required in consideration of a variation in position of the sleeve at the starting of the compressor, the sleeve 15 in the device in this embodiment is always held at a fixed set position at the starting of the compressor, as shown in FIG. 4, and hence, it is possible to design the strength of each of the members and the clutch capacity at proper values smaller than those in the prior art in accordance with the position of the sleeve.

In this embodiment, the device of the present invention has been described as being applied to the variable displacement compressor applied to the air-cooler for an automobile, but it will, of course, be understood that this device is also applicable to other variable displacement compressors.

What is claimed is:

1. A variable displacement compressor comprising a compressor body including a housing, a cylinder block and a cylinder head; a driving rotary shaft rotatably carried on said compressor body; a sleeve axially slidably carried on the driving rotary shaft within said housing; a journal about an axis perpendicular to an axis of the driving rotary shaft and connected to the rotary shaft; a swingable swash plate carried on said journal so as to be swingable only about the axis of said journal; a plurality of operating pistons connected to said swingable sash plate through a plurality of connecting rods; and a plurality of cylinders disposed around said driving rotary shaft in said cylinder block and each having the corresponding one of said operating pistons slidably received therein, wherein angular positions of said journal and said swingable swash plate are varied by controlling sliding movements of said sleeve, thereby varying operation strokes of said operating pistons, said compressor further including a starting displacement setting device comprising:

a first spring disposed on one of axial opposite sides of said sleeve for biasing said sleeve in one of axial opposite directions and holding a stopper, with which the sleeve is engagable, at a stop position on the driving rotary shaft, a second spring weaker than the first spring, disposed on the axial other side of said sleeve for biasing said sleeve in the other axial direction, such that at the time of starting of said compressor, said first spring holds said stopper at the stop position against a repulsive force of said second spring to hold said sleeve engaged with the stopper at a fixed position, and wherein said driving rotary shaft is formed at one end thereof with a smaller diameter shank portion through a locking stepped portion which defines said fixed position, and said stopper is slidably fitted over said smaller diameter shank portion.

2. A starting displacement setting device according to claim 1, wherein said first spring is disposed around said smaller diameter shank portion with one of opposite ends of the spring being engaged on a spring seat which is fittedly locked on said smaller diameter shank portion and with its other end being engaged on one end face of said stopper.

3. A starting displacement setting device according to claim 2, wherein said stop position is a position at which said stopper is biased by said first spring and locked on said locking stepped portion.

4. A starting displacement setting device according to claim 1, wherein said housing is formed with an annular cylinder which surrounds said driving rotary shaft and an annular control piston is slidably received in the cylinder and is connected to said sleeve to operate the latter, and wherein said second spring is interposed between a bottom wall of said cylinder and said control piston.

5. A starting displacement setting device according to claim 1 or 4, wherein the spring load of said second spring at a point where said sleeve abuts against the stopper located at said stop position is set larger than a friction attendant on the movement of the sleeve toward said first spring.

6. A starting displacement setting device according to claim 5, wherein the spring load of said first spring at a point where said stopper is located at said stop position is set larger than the spring load of said second spring plus a friction attendant on the movement of the sleeve toward said second spring.

* * * * *